US006450596B1

(12) United States Patent
Lee

(10) Patent No.: US 6,450,596 B1
(45) Date of Patent: Sep. 17, 2002

(54) INTERLOCKING DEVICE FOR DRAWERS

(75) Inventor: Suntiago Lee, Hsin-Chuang (TW)

(73) Assignee: Nan Juen Industrial Co., Ltd. (TW)

( * ) Notice: Subject to any disclaimer, the term of this patent is extended or adjusted under 35 U.S.C. 154(b) by 0 days.

(21) Appl. No.: 09/714,160

(22) Filed: Nov. 17, 2000

(30) Foreign Application Priority Data

Oct. 26, 2000 (TW) ..... 89218626 U

(51) Int. Cl.[7] ..... E05C 9/08
(52) U.S. Cl. ..... 312/217; 312/222
(58) Field of Search ..... 312/217, 221, 312/215, 222, 330.1

(56) References Cited

U.S. PATENT DOCUMENTS 3,900,236 A * 8/1975 Goulish et al. ..... 312/217
4,355,851 A * 10/1982 Slusser ..... 312/215
5,176,436 A * 1/1993 Mitchell ..... 312/217 X
5,303,994 A * 4/1994 Elsholz ..... 312/222 X
5,634,701 A * 6/1997 Hendrich et al. ..... 312/222 X
5,997,114 A * 12/1999 Bischoff ..... 312/215
6,296,332 B1 * 10/2001 Lammens ..... 312/217

* cited by examiner

*Primary Examiner*—John G. Weiss
*Assistant Examiner*—Michael J. Fisher
(74) *Attorney, Agent, or Firm*—Troxell Law Office PLLC

(57) ABSTRACT

An interlocking device for drawers, especially for three or more drawers, comprises a plurality of units and each unit further comprises a channel, a base plate, two rotary blocks and a connecting bar. The channel is elongated with two bent lateral sides. The base plate is joined to an end of the channel. These two rotary blocks are oppositely disposed and rotatably fixed to the base plate. Each of rotary blocks is composed of a lower block part and an upper block part extending outward from the lower block part. The connecting bar at an end thereof rotatably engages with the rotary block, and the other end thereof rotatably engages with another rotary block on an adjacent unit. When one of these drawers is opened, slide rails at the outer side thereof move outward in the channel to push rotary blocks rotating outward. Thus, rotary blocks on other units rotate due to the movement of the connecting bar such that other drawers are prevented from slipping outward.

7 Claims, 5 Drawing Sheets

INTERLOCKING DEVICE FOR DRAWERS

BACKGROUND OF THE INVENTION

1. Field of the Invention

The present invention relates to an interlocking device for drawers. In particular, the present invention is related to an anti-disengagement device for two or more drawers by which the unopened drawer or drawers may keep in a closed state while one of the drawers is opened.

2. Description of Related Art

Conventionally, for a long period of time, drawers have been used for storing articles. Because the drawers can be selectively opened or closed individually, they are widely utilized in furniture, an office desk, file cabinet, and etc. In order to save the available space, it is known to arrange several drawers vertically and this kind of arrangement can be frequently seen in a file cabinet or an office desk.

The traditional structure of a drawer is provided with a stationary guide at an inner wall thereof and a movable guide is detachably fixed to an outer wall thereof engaged with the stationary guide. The movable guide may have bearings to improve the smoothness of moving while the drawer is opened or closed. In addition, two movable guides can be mounted with an extended sliding distance such that a pulled distance of the drawer can be lengthened and the deeper part of the drawer is accessible.

This arrangement of multiple drawers has a disadvantage that one of these drawers being opened may cause the rest to move outward unintentionally. In order to avoid the undesirable movement of drawers, an interlocking device was developed accordingly.

The U.S. Pat. No. 5,988,778, which is granted to Lammens, discloses an interlocking device provided with two followers at the outer end of a channel. These two followers are pushed to move upward and downward respectively by an end part at the front of the drawer such that followers on drawers directly above and below the drawer respectively are pushed to reduce the distance between followers. Thus, each drawer may be prevented from opening and a function of interlock can be performed. However, the device disclosed in the U.S. Pat. No. 5,988,778 is sophisticated in structure so that it is very time consuming during making and assembling the interlocking device.

SUMMARY OF THE INVENTION

The main object of the present invention is to provide an interlocking device for drawers, which not only offers a simple structure but also performs an excellent function to prevent drawers from opening.

Another object of the present invention is to provide an interlocking device for drawers, which is suitable for two or more drawers.

BRIEF DESCRIPTION OF THE DRAWINGS

The present invention can be more fully understood by referring to the following description and accompanying drawing, in which.

DETAILED DESCRIPTION OF THE PREFERRED EMBODIMENTS

Figure 1:
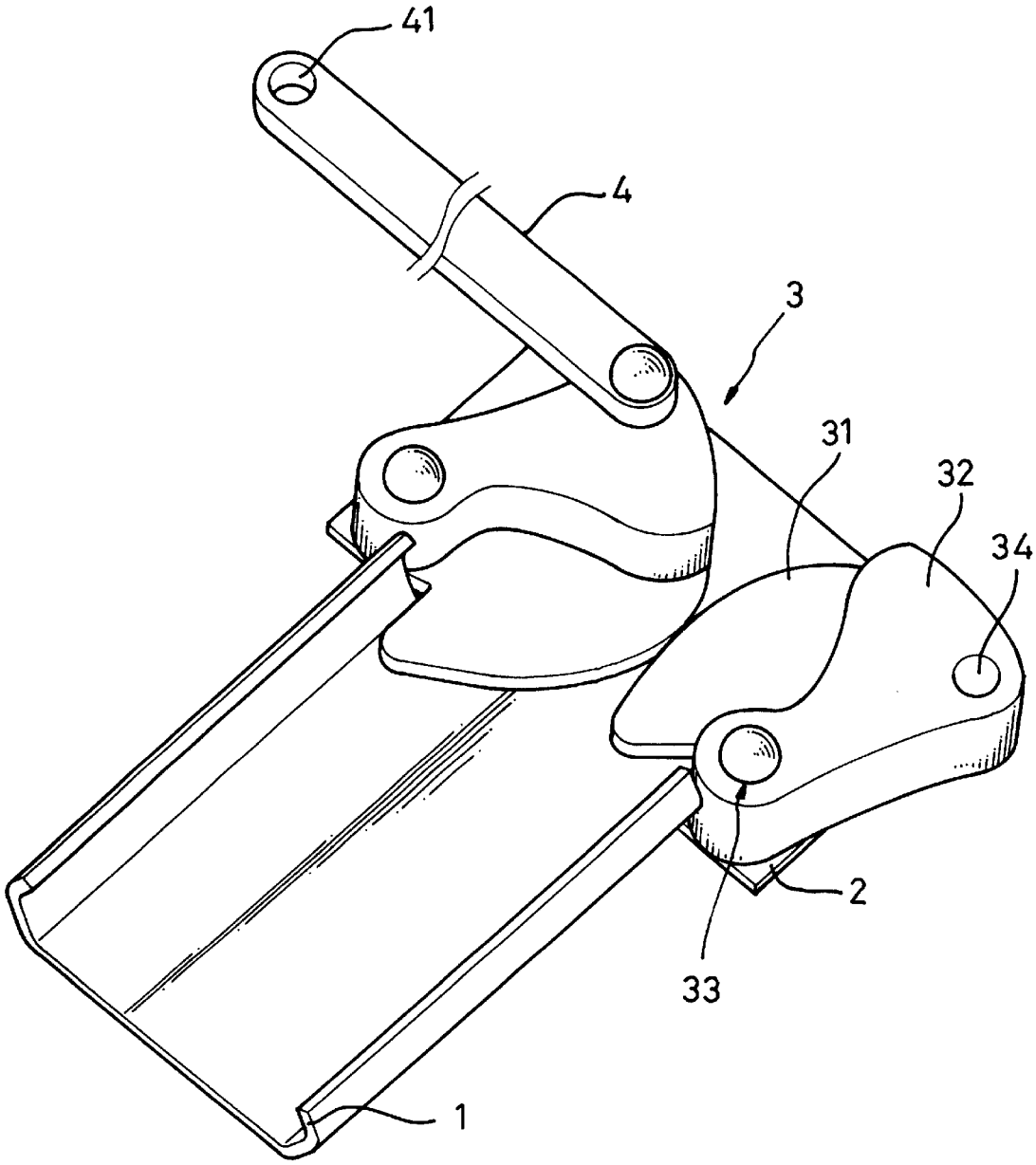
FIG. 1 is a perspective view of single unit in the interlocking device according to the present invention.
Figure 2:
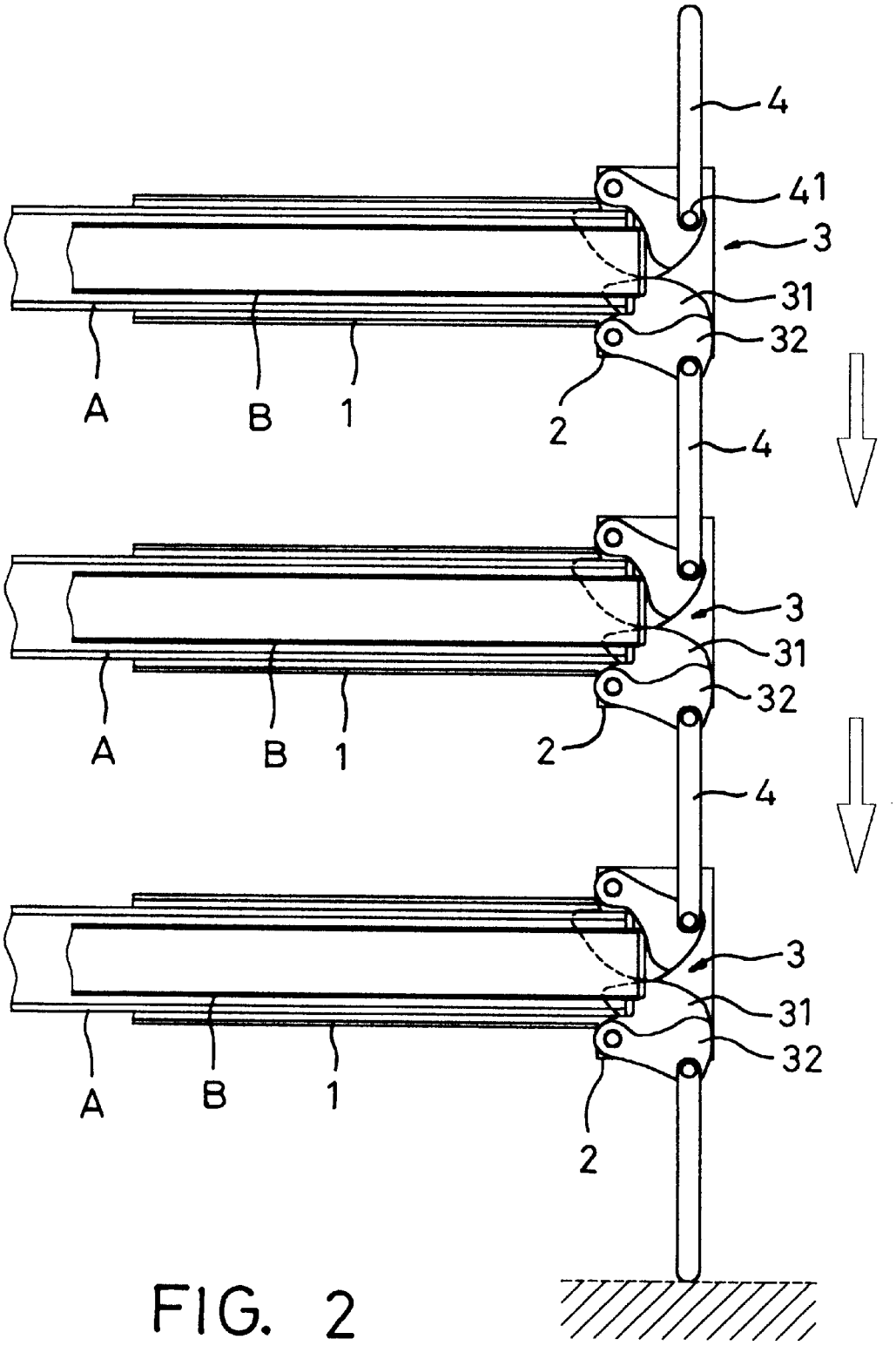
FIG. 2 is a plan view of the interlocking device of the present invention illustrating an embodiment for three or more drawers.
Figure 3:
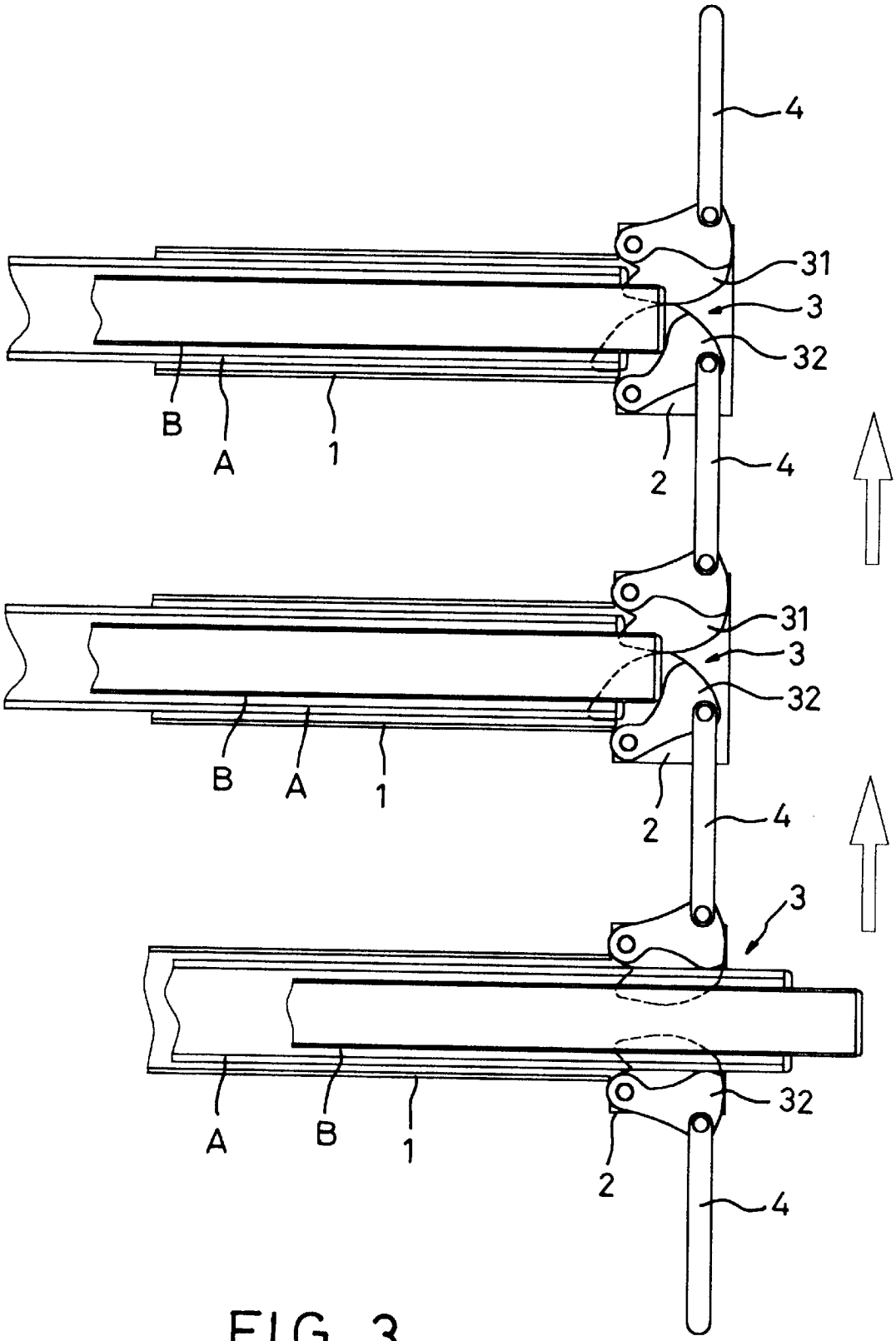
FIG. 3 is a plan view of the interlocking device shown in FIG. 2 in a state of being operated.

Referring to FIGS. 1, 2, and 3, the interlocking device for three or more drawers according to the present invention is composed of three or more interlocking units corresponding to the drawers provided. Each unit comprises a channel 1, a base plate 2, a pair of rotary blocks 3, and a connecting bar 4. The channel 1 is fixed to an inner wall of a cabinet (hollow part), receiving the drawer. The pair of rotary blocks 3 are composed of two symmetrical rotary blocks opposite to each other.

The channel 1 is elongated with two bent lateral sides. The channel 1 is fixedly attached to one of two opposite inner walls of cabinet for receiving the drawer. That is, two channels 1 are disposed symmetrically and oppositely to each other. The respective channel 1 can be made integrally by way of injection molding or metalworking.

The base plate 2 is a flat plate joined to the channel 1. In case of the assembly being made of metal, the base plate 2 and the channel 1 may be integrally made by a metal sheet. An engaging hole 2 (not shown because of projecting angle) may be provided on the base plate 2 to be close to the channel 1 so as to engage with rotary blocks 3.

Each rotary block 3 is solid and composed of a lower block part 31 and an upper block part 32. The height of the upper block part 32 is corresponding to an intermediate rail A and/or an extending rail B joining to an outer wall of the drawer so as to interact with each other. As shown in FIGS. 1, 2, and 3, the lower block part 31 has a circular arc extending toward the center of the channel 1. The upper block part 32 has an outline, which has a curve having recession and projection with respect to the center of the channel 1. An engaging hole 33 is provided on the rotary block 3 corresponding to the base hole such that the rotary block 3 can rotatably engage the base plate 2 by way of a pivot or a rivet or other equivalent ways. The upper block part 32 has an engaging hole 34 at the outer side thereof to join to the connecting bar 4.

The connecting bar 4 is elongated with connecting holes 41 at both ends thereof respectively to rotatably engage with the engaging hole 34 by way of a pivot, a rivet, or other equivalent ways. It is noted that both connecting holes on the connecting bar 4 engage with an engaging hole 34 of a rotary block on respective channels 1 adjacent to each other.

Referring to FIG. 2 again, each channel 1 is fixedly attached to the inner wall of each cabinet for receiving a drawer. The connecting bar 4 at an end thereof connects with the rotary block 3 by way of the engaging hole 34 joining to the connecting hole 41. By the same token, the other end of the connecting bar 4 connects with a rotary block 3 on another channel 1 directly above or below the channel 1. As shown, each drawer with the intermediate rail A and the extending rail B is closed and the intermediate rail A and the extending rail B are retreated in the upper block part 32.

When any one of these drawers is opened as shown in FIG. 3, the respective intermediate rail A and the respective extending rail B are pulled outwardly to press against the respective upper block part 32. In this way, the respective rotary block 3 is rotated such that all rotary blocks 3 at other closed drawers are rotated to move upward and keep the other closed drawers from slipping outward. Meanwhile, the upper and lower inner walls of each cabinet may act as a stopper for respective connecting bar 4 during moving upward or downward.

As shown in FIG. 3, the uppermost and the lowermost drawers have their outer connecting bars 4 in contact with a top part and a bottom part enclosing these drawers. Alternatively, the uppermost and the lowermost rotary blocks are arranged to have the respective lower block part only such that the respective lower block part is joined to the inner wall of the respective cabinet. In other words, the respective outer rotary block 3 at the uppermost or the lowermost drawers is provided with the lower block part 31 and/or the upper block part 32.

Figure 4:
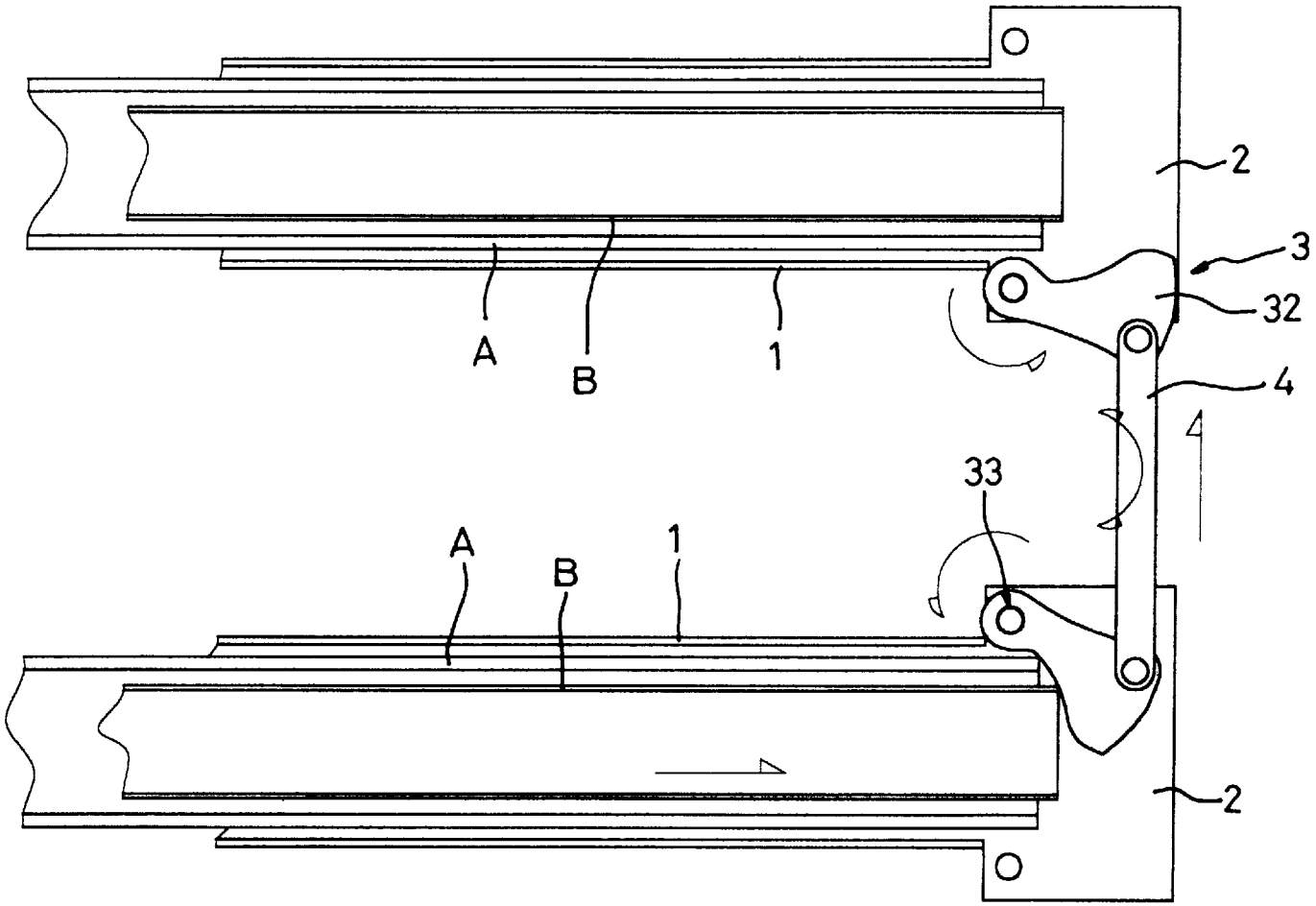
FIG. 4 is a plan view of the interlocking device of the present invention illustrating an embodiment for two drawers.

Referring to FIG. 4, an upper block part 32 is provided on the respective interlocking device only and a respective connecting bar 4 is pressed against the top part and the bottom part at the upper cabinet and the lower cabinet, while two drawers are provided only. Alternatively, a respective lower block part 31 is provided to fix to the inner wall of the cabinets respectively to constitute interlock.

Figure 5:
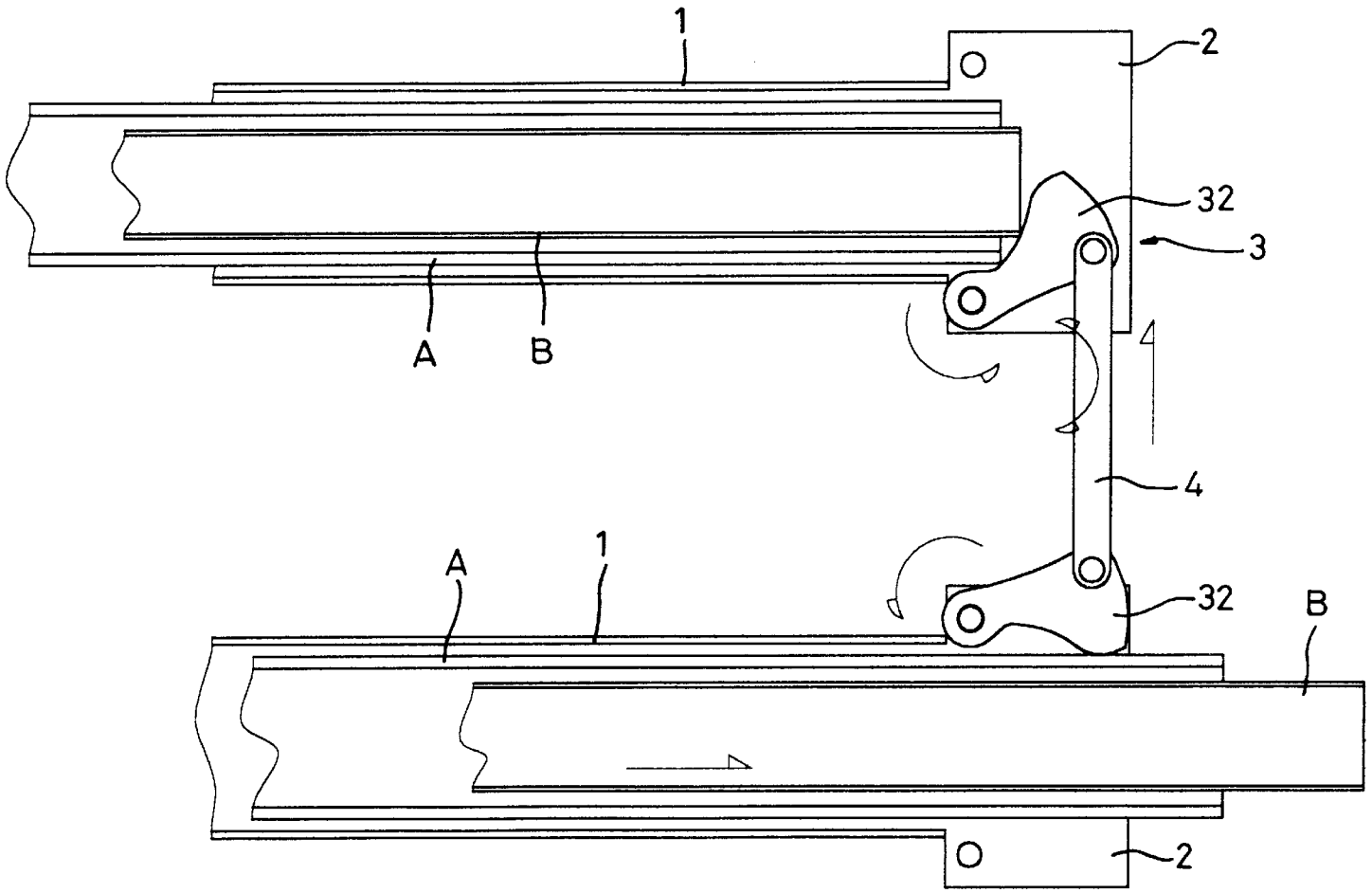
FIG. 5 is a plan view of the interlocking device shown in FIG. 4 in a state of being operated.

Referring to FIG. 5, once one of these two drawer is opened, the upper block part 32 thereof is pushed upward to move the connecting bar 4 and the other upper block part 32 is rotated to prevent the other drawer from slipping outward.

It is appreciated that the interlocking device according to the present invention has advantages such as being easily made and conveniently assembled to promote its competition. In addition, the rotary movement provided in the present invention may avoid the sound and damage resulting from impact of upward and downward movements in the prior art.

While the invention has been described with reference to preferred embodiments thereof, it is to be understood that modifications or variations may be easily made without departing from the spirit of this invention, which is defined by the appended claims.

What is claimed is:

1. An interlocking device for drawers, especially for three or more drawers, including a plurality of adjacent units, each unit comprising:

an elongated channel with two bent lateral sides;

a base plate joined to an end of the channel;

upper and lower rotary blocks oppositely disposed and each rotatably fixed to the base plate, each of said upper and lower rotary blocks including at least one of a lower block part, and an upper block part extending outwardly from the lower block part; and a connecting bar having a first end thereof rotatably engaging an outer area of the upper block of one unit, and a second end thereof rotatably engaging with a lower rotary block on an adjacent unit;

whereby, when one of these drawers is opened, a slide rail at an outer side of the drawer moves outward in the channel to rotate said rotary blocks such that rotary blocks on adjacent units rotate by movement of the connecting bar to prevent other drawers from slipping outwardly.

2. The interlocking device for drawers, especially for three or more drawers, according to claim 1, wherein each of said rotary blocks is joined to said base plate by way of engaging holes and a rivet.

3. The interlocking device for drawers, especially for three or more drawers, according to claim 1, wherein said connecting bar at said end has a connecting hole connected to an engaging hole at said upper block part by way of a rivet.

4. The interlocking device for drawers, especially for three or more drawers, according to claim 1, wherein said base plate and the channel are made integrally as one piece.

5. The interlocking device for drawers, especially for three or more drawers, according to claim 1, wherein said upper block part is pushed by an intermediate rail and an extending rail on the opened drawer.

6. The interlocking device for drawers, especially for three or more drawers, according to claim 1, wherein an upper rotary block of an uppermost unit and a lower rotary block at a lowermost unit comprises only the upper block part.

7. The interlocking device for drawers, especially for three or more drawers, according to claim 1, wherein said upper block part includes an arcuate inner side.

* * * * *